US011976669B2

(12) United States Patent
Kato

(10) Patent No.: US 11,976,669 B2
(45) Date of Patent: May 7, 2024

(54) HOUSING FOR AXIAL FAN AND AXIAL FAN

(71) Applicant: NIDEC SERVO CORPORATION, Kiryu (JP)

(72) Inventor: Yoshihiko Kato, Kiryu (JP)

(73) Assignee: NIDEC SERVO CORPORATION, Gunma (JP)

( * ) Notice: Subject to any disclaimer, the term of this patent is extended or adjusted under 35 U.S.C. 154(b) by 0 days.

(21) Appl. No.: 18/137,638

(22) Filed: Apr. 21, 2023

(65) Prior Publication Data

US 2023/0304509 A1 Sep. 28, 2023

(30) Foreign Application Priority Data

Mar. 22, 2022 (JP) ..... 2022-045237

(51) Int. Cl.
*F04D 29/54* (2006.01)

(52) U.S. Cl.
CPC ..... *F04D 29/544* (2013.01); *F04D 29/542* (2013.01)

(58) Field of Classification Search
CPC ..... F04D 29/542; F04D 29/544
See application file for complete search history.

(56) References Cited

U.S. PATENT DOCUMENTS 6,278,207 B1 8/2001 Matsumoto
D696,764 S * 12/2013 Sato ..... D23/370
D732,655 S * 6/2015 Ueno ..... D23/370
2003/0007872 A1 1/2003 Bradbury et al.
2004/0251000 A1* 12/2004 Chang ..... H05K 7/20172 257/E23.099
2007/0122285 A1* 5/2007 Miyazawa ..... F04D 29/544 416/191
2008/0053639 A1 3/2008 Lin et al.
2008/0193287 A1* 8/2008 Kobayashi ..... F04D 29/542 264/299
2013/0171015 A1 7/2013 Oguma et al.
2016/0061220 A1* 3/2016 Stanley ..... F04D 29/582 415/169.2

FOREIGN PATENT DOCUMENTS

JP 2001-186713 A 7/2001
JP 2003-009470 A 1/2003
JP 2004-190576 A 7/2004
JP 2008-106739 A 5/2008
JP 5002664 B2 8/2012
JP 2013-138576 A 7/2013
JP 5707834 B2 4/2015
JP 2015-094228 A 5/2015

* cited by examiner

*Primary Examiner* — Audrey B. Walter
(74) *Attorney, Agent, or Firm* — Keating & Bennett, LLP

(57) ABSTRACT

A housing of an axial fan that allows air to flow in an axial direction includes a frame including, on an inner surface, an air channel through which air flows, stator vanes extending radially inward from the inner surface, a motor housing supported radially inward of the stator vanes, and a motor supported on one axial side of the motor housing. A portion of the stator vanes is provided on a surface on the other axial side of the motor housing.

6 Claims, 4 Drawing Sheets

HOUSING FOR AXIAL FAN AND AXIAL FAN

CROSS-REFERENCE TO RELATED APPLICATIONS

The present application claims priority under 35 U.S.C. § 119 to Japanese Patent Application No. 2022-045237, filed on Mar. 22, 2022, the entire contents of which are hereby incorporated herein by reference.

1. FIELD OF THE INVENTION

The present disclosure relates to a housing of an axial fan and an axial fan.

2. BACKGROUND

With progress of downsizing and speeding up of electronic equipment, heat generation from the equipment has increased. Therefore, cooling of the electronic equipment using an axial fan is widely practiced. However, cooling of electronic equipment in recent years is required to have higher air volume-static pressure characteristics than ever before, and heat generation of a motor that drives a fan is also increasing.

When the temperature of a motor portion rises, electronic components, bearings, and the like used in the motor are exposed to high temperature, which possibly leads to deterioration of the components and a decrease in life. Therefore, lowering the temperature of the motor portion is essential for improving the quality.

Conventionally, there is known an axial fan in which a heat dissipation fin is arranged on a surface of a motor base part opposite to a bearing support. In the conventional axial fan, the heat from the circuit board is efficiently dissipated by the heat dissipation fin, and is not conducted to a spoke portion. The conventional axial fan is known to further improve a heat dissipation effect and prevent deformation of a casing.

However, the conventional axial fan has a problem in which provision of a heat dissipation fin makes the axial dimension long and the axial fan becomes large. Since the heat dissipation fin is locally arranged, cooling efficiency is not sufficient.

SUMMARY

A housing of an axial fan according to an example embodiment of the present disclosure allows air to flow in an axial direction and includes a frame including, on an inner surface, an air channel through which air flows, stator vanes extending radially inward from the inner surface, a motor housing supported radially inward of the stator vanes, and a motor supported on one axial side of the motor housing, in which a portion of the stator vanes is provided on a surface on the other axial side of the motor housing.

An axial fan according to an example embodiment of the present disclosure includes a housing of the axial fan and an impeller that is rotatable by the motor.

The above and other elements, features, steps, characteristics and advantages of the present disclosure will become more apparent from the following detailed description of the example embodiments with reference to the attached drawings.

DETAILED DESCRIPTION

Axial fans according to example embodiments of the present disclosure will be described below with reference to the drawings. The scope of the present disclosure is not limited to the example embodiments described below, and can be optionally changed within the scope of the technical ideas of the present disclosure. The following drawings may include scales, numbers, and the like of the structure different from those of an actual structure for the sake of easier understanding of the structure.

Figure 1:
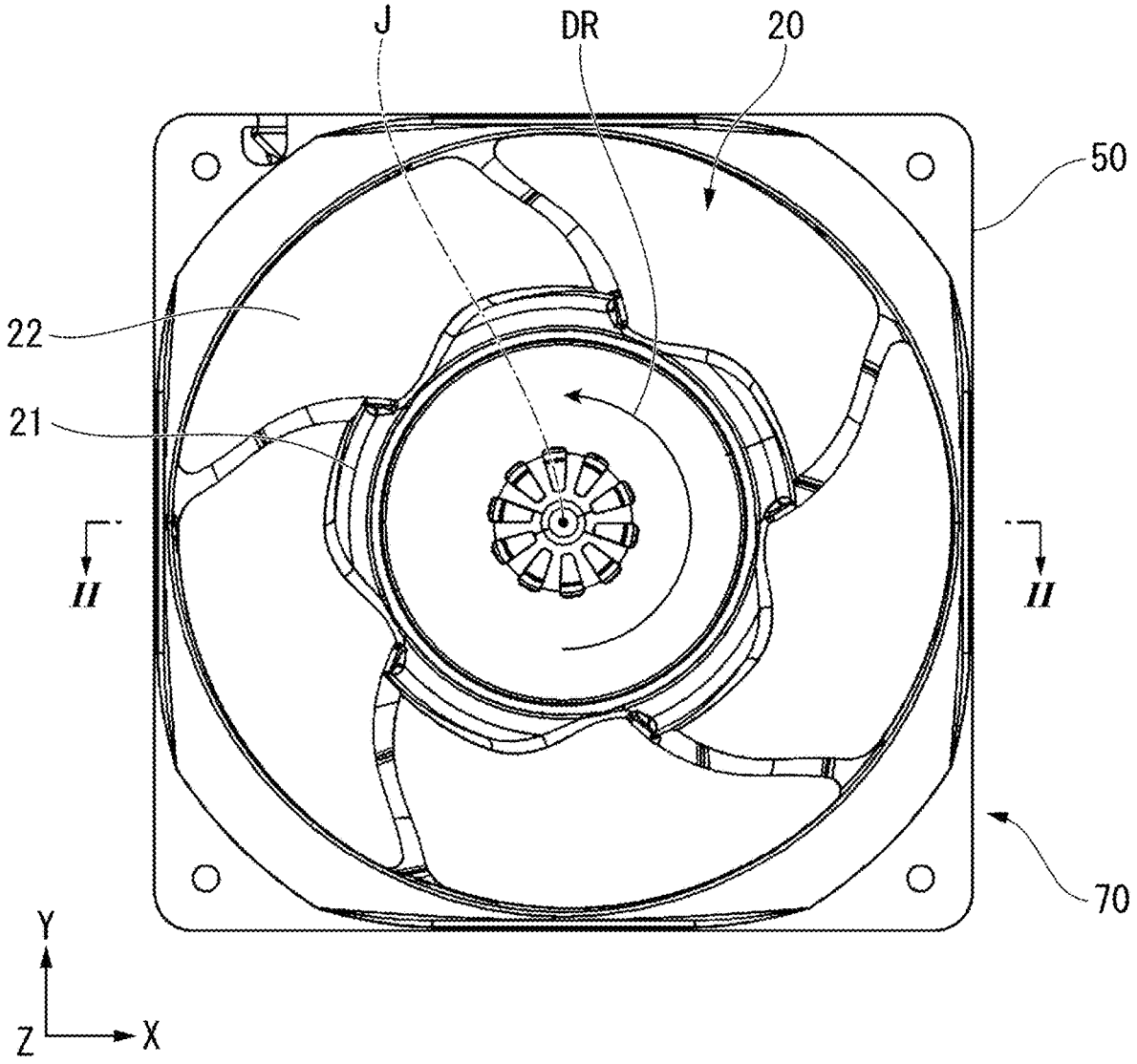
FIG. 1 is a view of an axial fan according to an example embodiment as viewed from above.

As shown in FIG. 1, an axial fan 10 of the present example embodiment is used as an electric cooling fan for air-cooling electronic equipment, for example.

Figure 2:
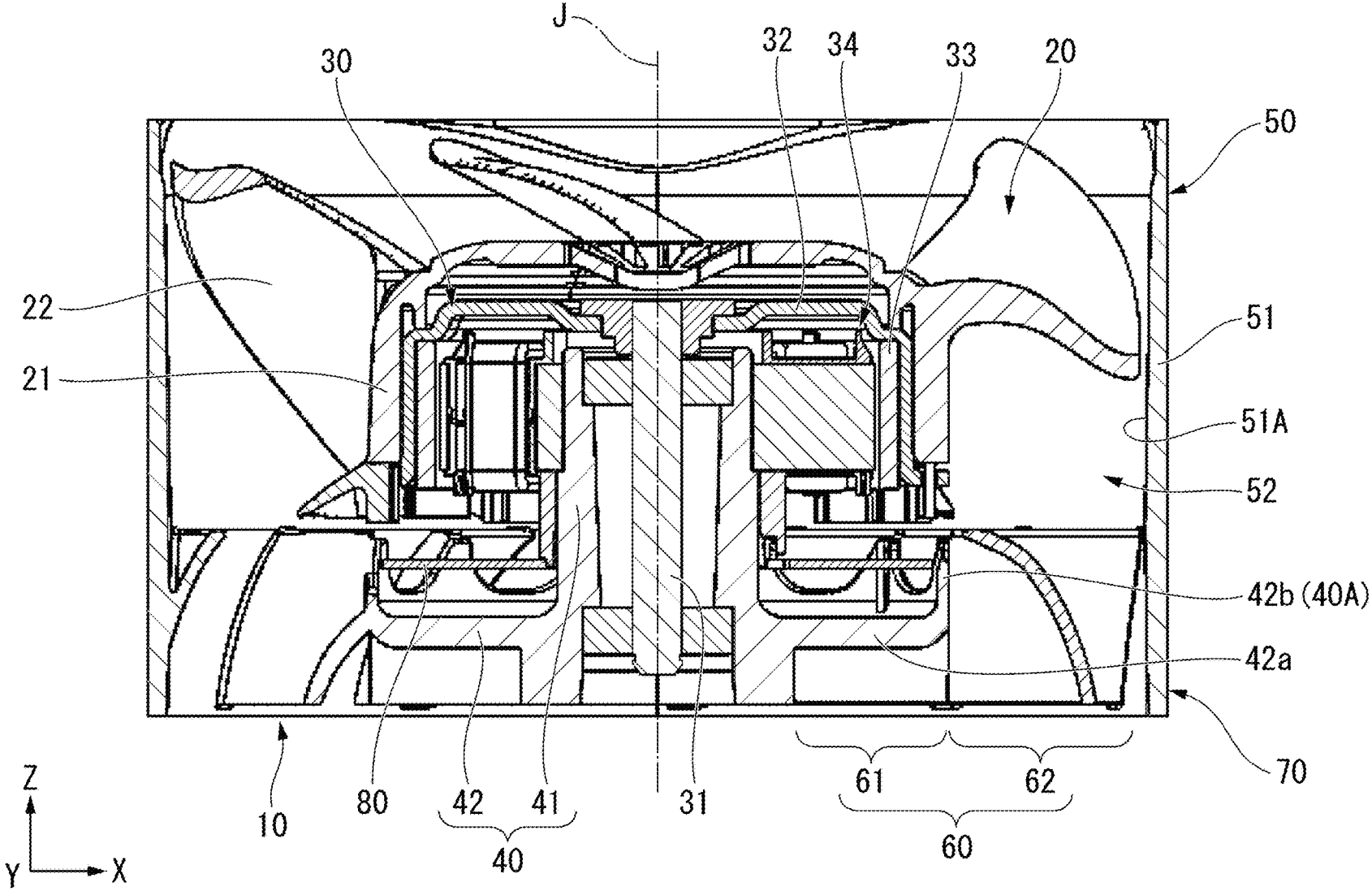
FIG. 2 is a view showing an axial fan according to an example embodiment of the present disclosure, and is a cross-sectional view taken along line II-II in FIG. 1.
Figure 3:
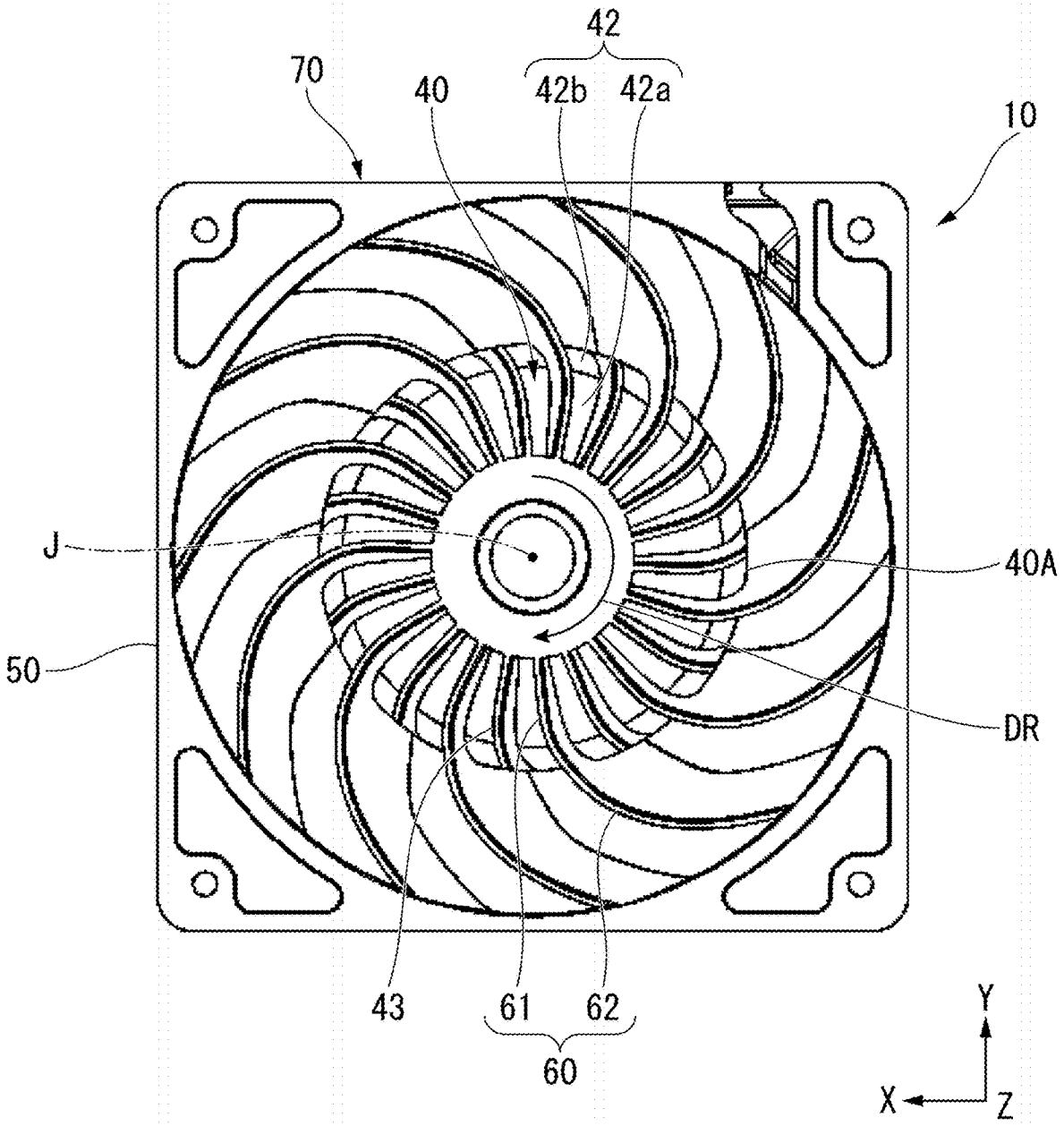
FIG. 3 is a view of an axial fan according to an example embodiment of the present disclosure as viewed from below.

As shown in FIGS. 1 to 3, the axial fan 10 includes an impeller 20, a housing 70, and a circuit board 80. The impeller 20 is rotatable about a center axis J extending in one direction.

In the XYZ coordinate system shown in each figure, a Z-axis direction is a direction parallel to the direction in which the center axis J extends, and is defined as an up-down direction. An X-axis direction is a horizontal direction orthogonal to the Z-axis direction. A Y-axis direction is a horizontal direction orthogonal to both the Z-axis direction and the X-axis direction.

In the following description, the Z-axis direction, i.e., a direction parallel to the center axis J will be simply called "axial", a radial direction centered on the center axis J will be simply called "radial", and a circumferential direction centered on the center axis J will be simply called "circumferential". A direction parallel to the Z-axis direction is called "up-down direction". A positive side in the Z-axis direction is called "upper", and a negative side in the Z-axis direction is called "lower". In the present example embodiment, the "up/upper" corresponds to one axial side in the direction, and the "down/lower" corresponds to the other axial side. The up-down direction, the horizontal direction, the upper side, and the lower side are names used merely for description, and do not limit the actual positional relationships and directions.

The impeller 20 includes an impeller cup 21 and a plurality of vanes 22. The impeller cup 21 has a tubular shape opening downward. The plurality of (five in FIG. 1) vanes 22 are arranged along the circumferential direction on the outer peripheral surface of the impeller cup 21.

The housing 70 includes a frame 50, a plurality of stator vanes 60, a motor housing 40, a motor 30, and a rib 43. As shown in FIG. 2, the motor 30 is arranged radially inside the impeller 20, and rotates the impeller 20 about the center axis J. More specifically, the motor 30 is arranged inside the impeller cup 21. In the present example embodiment, the motor 30 rotates the impeller 20, for example, in a counterclockwise orientation as viewed from above. In the following description, a side on which the vane 22 advances in the circumferential direction, that is, a side on which the vane 22 advances counterclockwise as viewed from the upper side, is sometimes called "downstream", and a side opposite to the side on which the vane 22 advances in the circumferential direction, that is, a side on which the vane 22 advances clockwise as viewed from the upper side is sometimes called "upstream". An arrow DR shown in each figure indicates the orientation in which the impeller 20 rotates. In the present example embodiment, the downstream corresponds to the other circumferential side, and the upstream corresponds to one circumferential side.

The motor 30 includes a shaft 31, a stator 34, a rotor cup 32, and a rotor magnet 33. The shaft 31 extends in the axial direction about the center axis J.

The shaft 31 is inserted radially inside a stator support 41 described later. The shaft 31 is rotatably supported on a radially inner surface of the stator support 41 via a bearing. The rotor cup 32 is fixed to an upper end of the shaft 31. The stator 34 has an annular shape circumferentially surrounding the shaft 31. The stator 34 is fixed to the outer peripheral surface of the stator support 41. The fixing method of the stator 34 includes fitting, bonding, and press-fitting, and is not particularly limited. The stator 34 is electrically connected to the circuit board 80.

The rotor cup 32 has a tubular shape opening downward, and is arranged radially outside the stator 34. The upper part of the rotor cup 32 is arranged radially inside the impeller cup 21. The rotor cup 32 is fixed to the impeller cup 21. The fixing structure of the rotor cup 32, the impeller cup 21, and the shaft 31 is not limited to this. The rotor magnet 33 is fixed to the inner peripheral surface of the rotor cup 32. The rotor magnet 33 has, for example, a cylindrical shape. The rotor magnet 33 radially opposes the stator 34 with a gap interposed therebetween radially outside the stator 34.

The motor housing 40 supports the motor 30 on the upper side. The motor housing 40 supports the motor 30 on the lower side of the impeller 20. The motor housing 40 includes an accommodation 42 and the stator support 41. The accommodation 42 has a cup shape opening upward. The accommodation 42 accommodates the circuit board 80. The accommodation 42 is arranged on the lower side of the motor 30.

The accommodation 42 includes a bottom surface 42*a* and a tube 42*b*. The bottom surface 42*a* expands in the radial direction. The tube 42*b* has a cup shape extending upward from a radially outer edge of the bottom surface 42*a*. The tube 42*b* circumferentially surrounds the radial outside of the circuit board 80. The stator support 41 extends upward from the bottom surface 42*a*. The stator support 41 has a cylindrical shape about the center axis J.

The circuit board 80 has a plate shape that expands in the radial direction. The circuit board 80 is arranged radially inside the tube 42*b*. The circuit board 80 is arranged on the lower side of the motor 30, and at least partially overlaps the motor 30 in the axial direction. The circuit board 80 is fixed to the motor housing 40, for example. A coil of the stator 34 is connected to the circuit board 80. Due to this, the circuit board 80 is electrically connected to the motor 30.

As shown in FIGS. 2 and 3, the frame 50 has a rectangular tube shape extending in the axial direction. The frame 50 circumferentially surrounds the impeller 20 and the motor 30 from the radially outer side. The frame 50 has a peripheral wall 51. The peripheral wall 51 has a tubular shape extending in the axial direction. In the frame 50, an air channel 52 is constituted by an inner surface 51A including a cylindrical surface in the peripheral wall 51. That is, the frame 50 includes, on the inner surface 51A, the air channel 52 through which air flows.

Figure 4:
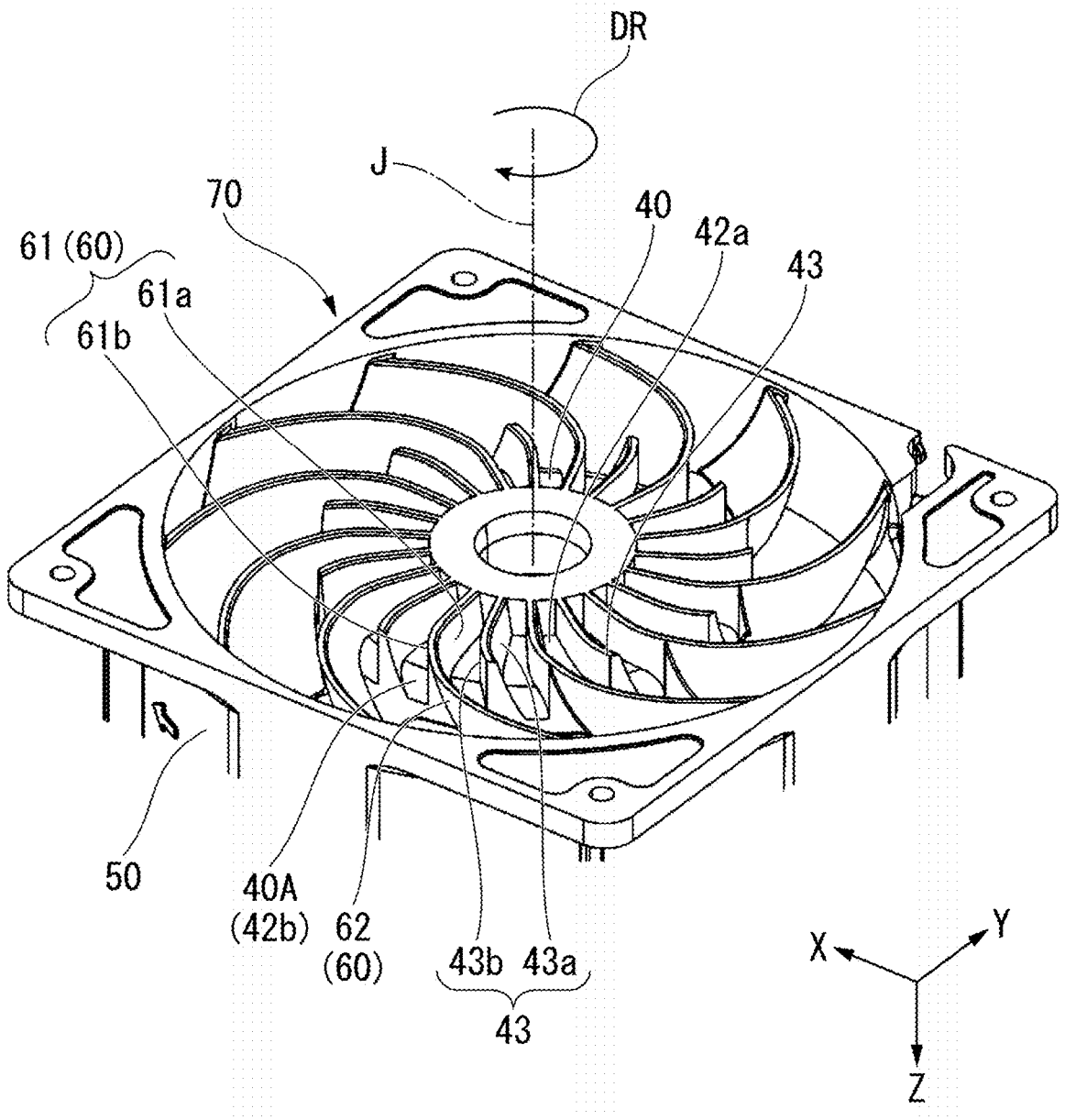
FIG. 4 is a partial perspective view of an axial fan according to an example embodiment of the present disclosure as viewed from below.

As shown in FIGS. 3 and 4, each of the plurality of stator vanes 60 extends radially inward from the inner surface 51A of the frame 50. The plurality of stator vanes 60 are arranged at equal intervals along the circumferential direction. In FIG. 3, eleven stator vanes 60 are provided. The stator vanes 60 connect the inner surface 51A of the frame 50 and the motor housing 40. The stator vanes 60 are arranged radially across the air channel 52.

Due to this, the heat generated in the motor 30 is transferred to the stator vanes 60 radially outside relative to the motor housing 40 via the stator support 41 and the accommodation 42 in the motor housing 40. The heat transferred to the stator vanes 60 is efficiently dissipated by the air flowing through the air channel 52.

When viewed in the axial direction from below, the stator vanes 60 are curved in a direction toward the upstream side, which is one circumferential side, radially outward from the center axis J side. When viewed in the axial direction from below, the stator vanes 60 are curved in a direction toward the counterclockwise side in the circumferential direction radially outward from the center axis J side.

This can increase the surface area of the stator vanes 60 as compared with the case where the stator vanes 60 extend linearly in the radial direction. This increases the heat dissipation area in the stator vanes 60, and can more efficiently dissipate the heat generated in the motor 30.

The stator vane 60 includes a first portion 61 and a second portion 62. The first portion 61 is positioned radially inside relative to an outer periphery 40A of the tube 42*b* of the motor housing 40. The first portion 61 is provided on a lower surface of the motor housing 40. The first portion 61 protrudes downward from the bottom surface 42*a*.

Due to this, the heat generated in the motor 30 is transferred to the stator vanes 60 also on the lower side of the motor housing 40, and is more efficiently dissipated by the air flowing through the air channel 52.

The second portion 62 is positioned radially outside relative to an outer periphery 40A of the tube 42*b* of the motor housing 40. The first portion 61, the second portion 62, and the motor housing 40 are integrated. The first portion 61, the second portion 62, and the motor housing 40 are an integrally molded body. The first portion 61 and the second portion 62 are continuously connected on the lower side from the bottom surface 42*a* in the axial direction, and are curved in a direction toward the counterclockwise side in the circumferential direction from the center axis J side toward the radial outside.

This causes the air flowing through the air channel 52 and straightened by the stator vanes 60 to easily flow continuously and smoothly in the first portion 61 and the second portion 62, and can more efficiently dissipate the heat generated in the motor 30.

Both the downstream surface and the upstream surface of the second portion 62 are inclined in a direction toward the upstream side as going upward. As shown in FIG. 4, the first portion 61 has a first side surface 61*a* and a second side surface 61*b*. The first side surface 61*a* is positioned on the upstream side of the first portion 61. The first side surface 61*a* is inclined with respect to the axial direction in a direction toward the upstream side from the lower tip toward the upper side. The second side surface 61*b* is positioned on the downstream side of the first portion 61. The second side surface 61*b* is parallel to the axial direction.

This causes the air flowing through the vane surface of the second portion 62 to easily flow into the first portion 61. Therefore, the heat generated in the motor 30 can be dissipated more on the lower side of the motor housing 40.

The rib 43 protrudes downward from the lower surface of the motor housing 40. The rib 43 protrudes downward from the bottom surface 42*a*. The rib 43 is positioned between the first portions 61 circumferentially adjacent to each other. By providing the rib 43 protruding downward from the lower surface of the motor housing 40, the heat dissipation area on the lower surface of the motor housing 40 increases, and the heat dissipation of the heat generated in the motor 30 can be further facilitated.

The rib 43 has a third side surface 43*a* and a fourth side surface 43*b*. The third side surface 43*a* is positioned on the upstream side of the rib 43. The third side surface 43*a* is inclined with respect to the axial direction in a direction toward the upstream side from the lower tip toward the upper side. The fourth side surface 43*b* is positioned on the downstream side of the rib 43. The fourth side surface 43*b* is parallel to the axial direction.

This causes the air flowing through the vane surface of the stator vane 60 to easily flow into the rib 43. Therefore, the heat generated in the motor 30 can be dissipated more on the lower side of the motor housing 40.

The rib 43 viewed from below in the axial direction has the same shape as that of the first portion 61.

This can uniform more the heat dissipation characteristics on the lower surface of the motor housing 40. It is possible to achieve efficient design of the first portion 61, the second portion 62, and the motor housing 40, efficient design of a mold used for integrally molding them, and reduction in manufacturing cost.

According to the present example embodiment, since a part of the stator vanes 60 is provided on the lower surface of the motor housing 40, it is possible to improve cooling efficiency with respect to heat generated in the motor 30 without increasing the size of the axial fan 10.

While the example embodiment according to the present disclosure has been described above with reference to the accompanying drawings, it is obvious that the present disclosure is not limited to the example embodiment. Various shapes, combinations, and the like of the constituent members described in the above example are only by way of example, and various modifications are possible based on design requirements and the like without departing from the scope of the present disclosure.

For example, in the above example embodiment, the configuration in which the stator vanes 60, the motor housing 40, and the frame 50 are an integrally molded body is exemplified, but the present disclosure is not limited to this configuration. For example, a separately produced stator vane 60 may be fixed to at least one of the motor housing 40 and the frame 50.

In the above example embodiment, the configuration in which the rib 43 viewed from below in the axial direction has the same shape as that of the first portion 61 has been exemplified, but the present disclosure is not limited to this configuration, and the rib 43 may have a shape different from that of the first portion 61. The rib 43 may be an annular rib continuous to a plurality of the first portions 61 about the center axis J, for example. In a case of adopting this configuration, it is only required to provide one or a plurality of ribs.

Features of the above-described example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A housing of an axial fan that allows air to flow in an axial direction, the housing comprising:

a frame including, on an inner surface, an air channel through which air flows;

stator vanes extending radially inward from the inner surface;

a motor housing supported radially inward of the stator vanes; and a motor supported on one axial side of the motor housing; wherein a portion of the stator vanes is provided on a surface on another axial side of the motor housing;

the stator vanes include:

a first proton positioned radially inside relative to an outer periphery of the motor housing; and a second portion positioned radially outside relative to the outer periphery of the motor housing;

the axial fan further includes a rib positioned between ones of the first portions circumferentially adjacent to each other and protruding to the another axial side of the motor housing;

a third side surface on one circumferential side of the rib is inclined with respect to the axial direction in a direction toward both one circumferential side and one axial side from a tip end on the another axial side of the motor housing; and a fourth side surface on another circumferential side of the rib is parallel to the axial direction.

2. The housing of an axial fan according to claim 1, wherein the first portion, the second portion, and the motor housing are integrated.

3. The housing of an axial fan according to claim 1, wherein the stator vanes are curved in a direction toward one circumferential side from a center axis side toward a radial outside of the housing; and the first portion and the second portion are continuously connected and curved.

4. The housing of an axial fan according to claim 1, wherein a first side surface on one circumferential side of the first portion is inclined with respect to the axial direction in a direction toward one circumferential side toward one axial side from a tip end on another axial side; and a second side surface on another circumferential side of the first portion is parallel to the axial direction.

5. The housing of an axial fan according to claim 1, wherein the rib has a same shape as a shape of the first portion as viewed in the axial direction.

6. An axial fan comprising:

the housing of the axial fan according to claim 1; and an impeller that is rotatable by the motor.

* * * * *